United States Patent [19]

Shimizu et al.

[11] 4,246,560

[45] Jan. 20, 1981

[54] SELF-CONVERGING DEFLECTION YOKE

[75] Inventors: Toshiharu Shimizu; Takesuke Maruyama; Shuzo Matsumoto; Kei Yamashita; Atushi Takeyama, all of Yokohama, Japan

[73] Assignee: Hitachi, Ltd., Japan

[21] Appl. No.: 943,347

[22] Filed: Sep. 18, 1978

[30] Foreign Application Priority Data

Sep. 21, 1977 [JP] Japan ..... 52-112559

[51] Int. Cl.[3] ..... H01F 1/00; H01F 7/00

[52] U.S. Cl. ..... 335/212; 335/210; 335/213

[58] Field of Search ..... 335/210, 211, 212, 213

[56] References Cited

U.S. PATENT DOCUMENTS

| | | | |
|---|---|---|---|
| 2,704,816 | 3/1955 | Fernsler | 335/211 |
| 3,098,943 | 7/1963 | Reiches | 335/213 X |
| 3,711,802 | 1/1973 | Torsch | 335/213 X |
| 3,757,262 | 9/1973 | Over et al. | 335/213 |
| 4,117,432 | 9/1978 | Shizu | 335/213 X |
| 4,143,345 | 3/1979 | Barkow | 335/210 X |

*Primary Examiner*—Fred L. Braun

*Attorney, Agent, or Firm*—Craig & Antonelli

[57] ABSTRACT

A deflection yoke for use with a picture tube of a television receiver. A vertical deflection coil of the deflection coil has a larger winding angle on an electron gun side thereof than on a screen side thereof. A magnetic material piece is disposed inside the vertical deflection coil so that a vertical deflection magnetic field is formed into a strong barrel magnetic field on the electron gun side. As a result, a raster scanned on a faceplate of the picture tube is free from misconvergence and pincushion distortion. A core of the deflection yoke has sawtooth-shaped end surfaces, or auxiliary rings having sawtooth-shaped end surfaces are disposed on the end surfaces of the core. As a result, a wire of the vertical deflection coil is prevented from slipping on the end surfaces of the core although the wire of the vertical deflection coil is wound at a large winding angle on the electron gun side.

10 Claims, 9 Drawing Figures

SELF-CONVERGING DEFLECTION YOKE

FIELD OF THE INVENTION

The present invention relates to a deflection yoke for a color television receiver, and more particularly to a deflection yoke capable of reducing a pincushion distortion of a raster scanned on a faceplate of a picture tube.

In a conventional television receiver, a raster scanned on the faceplate of the picture tube includes much distortion and nonconvergence. In a self-converging deflection yoke for a color picture tube having inline electron guns, convergence is compensated by forming a magnetic field generated by a horizontal deflection coil into a pincushion field and forming a magnetic field generated by a vertical deflection coil into a barrel field, as is well known in the art. Accordingly, as for the pincushion deflection distortion (hereinafter referred to simply as pincushion distortion) at the left and right edge of a screen of a color television receiver, in addition to an inherent pincushion distortion due to a radius of curvature of the picture tube, a further pincushion distortion is added by the fact that the vertical deflection magnetic field is formed into an intensified barrel field in order to compensate for the convergence, resulting in the movement of electron beam normal to magnetic line of force created by the vertical deflection coil. A pincushion distortion compensation circuit is, therefore, usually provided to compensate for such pincushion distortion at the left and right edge of the screen. In order to simultaneously compensate for the convergence and the pincushion distortion by a deflection coil only, without using the pincushion distortion compensation circuit, it is necessary to form that portion of the vertical deflection magnetic field which faces the screen into a pincushion shape to compensate for the pincushion distortion, and at the same time to form that portion of the vertical deflection magnetic field which faces the electron guns into a barrel shape which is intensified enough to balance out the pincushion magnetic field on the screen side, to compensate for the convergence.

FIG. 1 shows a perspective view of a deflection yoke. A major section of the deflection yoke 1 includes a saddle-shaped horizontal deflection coil 2, a toroidal vertical deflection coil 3, a core 4 and a separator 5.

FIGS. 2A and 2B show the vertical deflection coil 3 which forms a pincushion magnetic field on the screen side and an intensified barrel magnetic field on the electron gun side. FIG. 2A is a perspective view and FIG. 2B is a front view. A feature of the vertical deflection coil 3 resides in that a winding angle $\phi_2$ of a coil 6, wound on the core 4, at a larger opening 4a located on the screen side is smaller than a winding angle $\phi_1$ at a smaller opening 4b located on the electron gun side. A drawback of this vertical deflection coil 3 resides in that a wire 7 is apt to slip on the surface of the core 4 and hence it is difficult to attain proper winding angles $\phi_1$ and $\phi_2$ because the wire 7 of the coil 6 wound at positions having larger winding angles $\phi_1$ and $\phi_2$ is wound obliquely to the core 4.

In the vertical deflection coil used for a picture tube having a large pincushion distortion such as a wide deflection angle picture tube, e.g. 90° deflection picture tube, the winding angle $\phi_1$ of more than 150° and the winding angle $\phi_2$ of approximately 80° are required. Therefore, the wire 7 wound at the position of the winding angle $\phi_1$ is especially apt to slip. It is, therefore, necessary to form the magnetic field on the electron gun side into an intensified barrel field without increasing the winding angle $\phi_1$ at the opening 4b located on the electron gun side to over 150°.

SUMMARY OF THE INVENTION

It is an object of the present invention to provide a deflection yoke having means for producing an intensified barrel magnetic field without materially increasing a winding angle at a smaller opening.

It is another object of the present invention to provide a deflection yoke in which a wire wound at a large winding angle position does not slip on a surface of a core.

The deflection yoke in accordance with the present invention comprises a vertical deflection coil having a smaller winding angle at a larger opening than a winding angle at a smaller opening, and a magnetic material piece disposed inside the vertical deflection coil. The deflection yoke of the present invention further includes a core having its end surfaces deformed or auxiliary ring for locking the wire. The deformed end surfaces of the core or the auxiliary ring are notched in sawtooth shape to prevent the wire of the vertical deflection coil from slipping.

When the magnetic material piece is disposed inside the vertical deflection coil, the shape of the vertical deflection magnetic field changes. Since the lines of magnetic force around the magnetic material piece pass in the body of the magnetic material piece or attracted thereto, the barrel magnetic field is further enhanced. Where the barrel magnetic field is enhanced, the pincushion magnetic field may be formed on the screen side. Accordingly, the pincushion distortion can be relieved.

If the end of the end surface of the core is normal to the wire of the vertical deflection coil, a force acting on the wire is normal to the end of the end surface and the slip of the wire on the end surface is prevented. The core of the deflection yoke of the present invention has its end surfaces notched in the sawtooth shape and the ends of the notched end surfaces are arranged to be normal to the wire of the vertical deflection coil, or the auxiliary ring having sawtooth-notched end surfaces is disposed over the end surfaces of the core. Consequently, the wire wound at the large winding angle position is prevented from slipping on the surface of the core.

DETAILED DESCRIPTION OF THE PREFERRED EMBODIMENTS

Figure 1:
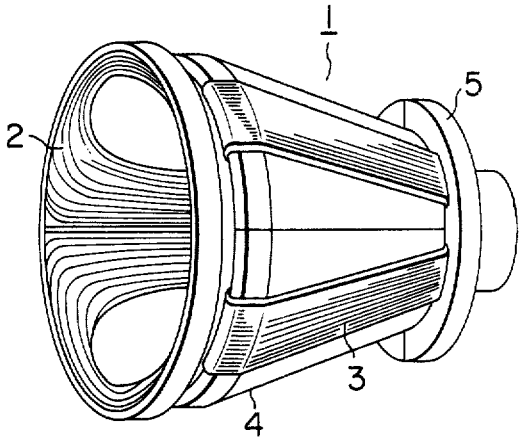
FIG. 1 PRIOR ART
FIG. 1 is a perspective view of a prior art deflection yoke.
Figure 2A:
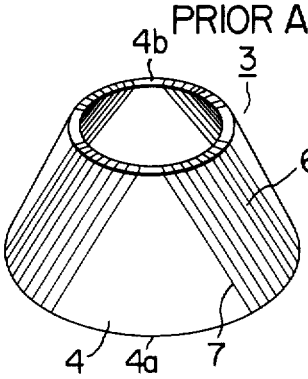
FIG. 2A PRIOR ART
FIG. 2A is a perspective view of a vertical deflection coil of the prior art.
Figure 2B:
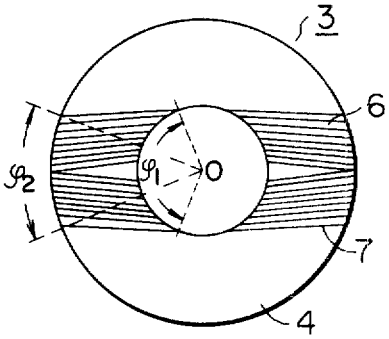
FIG. 2B PRIOR ART
FIG. 2B is a front view of the vertical deflection coil shown in FIG. 2A.
Figure 3:
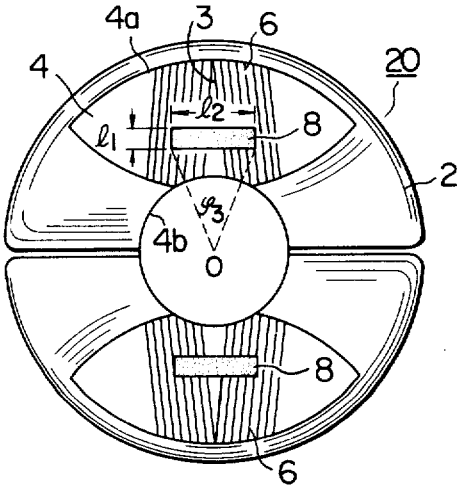
FIG. 3 is a front view of a deflection yoke of the present invention.
Figure 4:
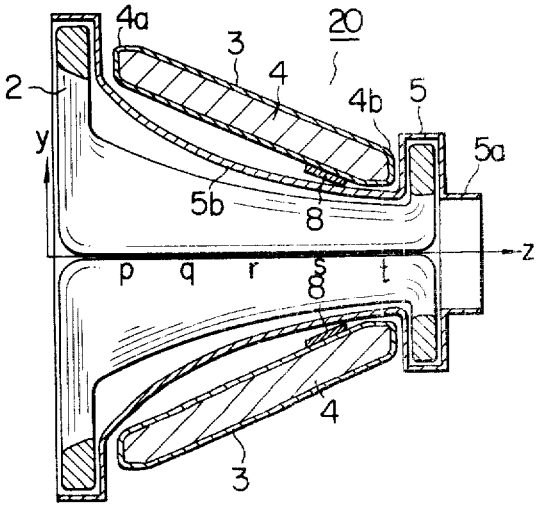
FIG. 4 is a sectional view of the deflection yoke of the present invention.

The preferred embodiments of the present invention will now be explained. Referring to FIG. 3, a deflection yoke 20 of the present invention includes a magnetic material piece 8 of iron or permaloy plate of rectangular or pedestal shape disposed inside a coil 6 of a vertical deflection coil 3. The magnetic material piece 8 is attached by bond or the like at a position closer to a smaller opening 4*b* in an inside of the coil 6, being separated from a larger opening 4*a* by $\frac{1}{2}$–$\frac{3}{4}$ of a full distance between both openings. The width $l_1$ of the magnetic material piece 8 is approximately 1/5–$\frac{1}{2}$ of the distance from the larger opening 4*a* of the vertical deflection coil to the smaller opening 4*b*. The length of the magnetic material piece 8 is chosen such that an angle $\phi_3$ looking into the magnetic material piece 8 from a center 0 is approximately 30°–70° C. By this magnetic material piece 8, the magnetic field on the side of the smaller opening 4*b* is formed into an intensified barrel field. In FIG. 3, a separator 5 is not shown. FIG. 4 shows a side sectional view of the deflection yoke 20 of the present invention, which clearly shows that the magnetic material piece 8 is attached to the vertical deflection coil 3 on the side of the smaller opening 4*b*. The magnetic material piece 8 may be attached to a horn-shaped portion 5*b* of the separator 5 instead of the vertical deflection coil 3, at a position close to a smaller opening 5*a* of the separator 5. In this case, a similarly intensified barrel field to that produced when it is attached to the vertical deflection coil 3 can be formed.

Figure 5:
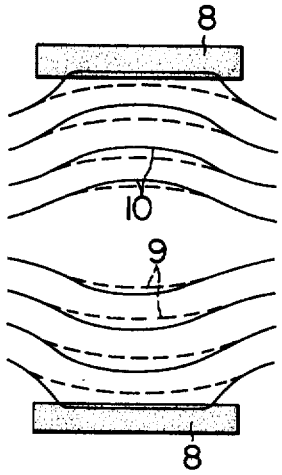
FIG. 5 shows a distribution graph of lines of magnetic force of a barrel magnetic field.

FIG. 5 shows a distribution graph of the lines of magnetic flux in the barrel magnetic field formed by the magnetic material piece 8, as looked from the larger opening side. The lines of magnetic force shown by dotted lines show lines of magnetic flux in the absence of the magnetic material piece 8 and the solid lines of magnetic flux show lines of magnetic flux in the presence of the magnetic material piece 8. Since the dotted lines of magnetic flux are altered to the solid lines of magnetic flux, the barrel magnetic field is enhanced.

Figure 6:
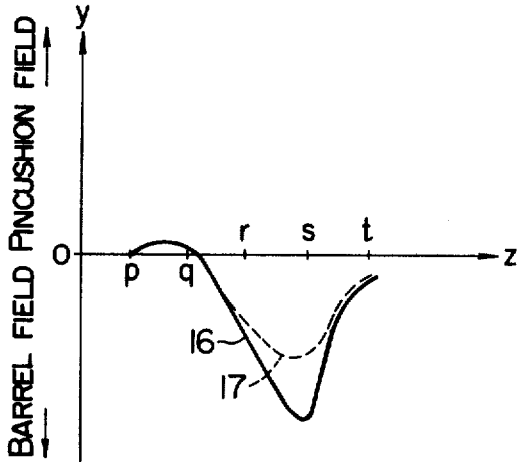
FIG. 6 shows a graph illustrating shapes of a pincushion magnetic field and a barrel magnetic field.

FIG. 6 shows shapes of the pincushion magnetic field and the barrel magnetic field, in which an abscissa represents a center axis z of the deflection yoke 20 shown in FIG. 4. A strength B of the vertical magnetic field in the deflection yoke is generally expressed by:

$$B = B_o + B_2 y^2$$

where $B_o$ is a strength of the magnetic field at any point on the z-axis and represents a strength of magnetic field in x-axis direction normal to the plane of drawing. A strength of magnetic field at a position displaced in y-axis direction from that point on the z-axis which assumes the magnetic field strength $B_o$ is given by the magnetic field strength B. $B_2$ is a constant. An ordinate in FIG. 6 represents $B_2/B_o$. If $B_2/B_o > 0$, the pincushion magnetic field is formed, if $B_2/B_o = 0$, a uniform magnetic field is formed, and if $B_2/B_o > 0$, the barrel magnetic field is formed. In FIG. 6, a solid line 16 shows a shape of the magnetic field in the presence of the magnetic material piece 8, and a broken line shows a shape of the magnetic field in the absence of the magnetic material piece 8. The z-axis of FIG. 6 corresponds to the z-axis shown in FIG. 4. It is seen from FIG. 6 that when the magnetic material piece 8 is attached, the barrel magnetic field is enhanced on the smaller opening side. As a result, the winding angle $\phi_1$ may be in the order of 150° and need not be more than 150°.

Figure 7:
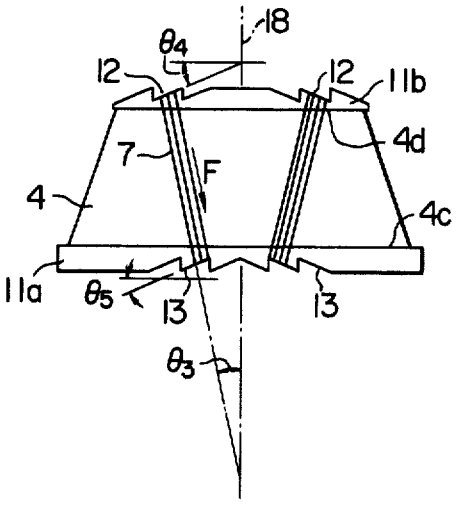
FIG. 7 is a side elevational view of a vertical deflection coil having an auxiliary ring of sawtooth shape.

Referring to FIG. 7, in the deflection yoke 20 of the present invention, there are provided auxiliary rings 11*a* and 11*b* on end surfaces 4*c* and 4*d* of the core 4 to prevent the wire 7 of the vertical deflection coil 3 from slipping on the end surfaces 4*c* and 4*d* of the core 4. When the wire 7 intersects a center line 18 with an angle $\theta_3$, end surfaces of the auxiliary rings 11*a* and 11*b* are divided into small areas 12 and 13 in sawtooth shape with the small areas 12 and 13 intersecting a plane normal to the center line at angles of $\theta_4$ and $\theta_5$, respectively. When the angles $\theta_4$ and $\theta_5$ are equal to the angle $\theta_3$, tensile force acting on the wire 7 is normal to the small areas 12 and 13 and hence the wire 7 does not slip.

Figure 8:
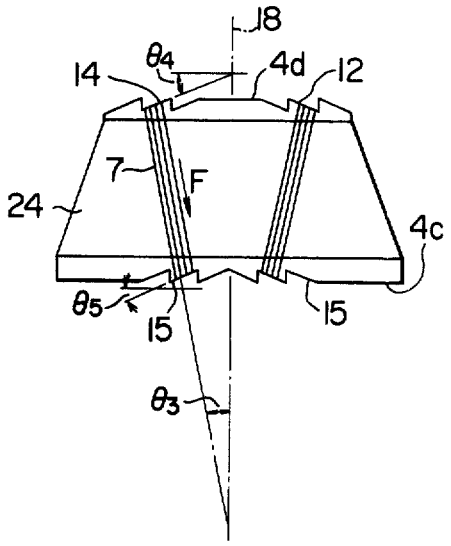
FIG. 8 is a side elevational view of a vertical deflection coil wound on a core having its end surfaces deformed into sawtooth shape.

In FIG. 8, the wire 7 of the vertical deflection coil 3 is wound on a core 24 having its end surfaces 4*c* and 4*d* deformed into sawtooth shape. The end surfaces 4*c* and 4*d* of the core 24 have small areas 14 and 15 formed in sawtooth shape, like in the case of the auxiliary rings 11*a* and 11*b* shown in FIG. 7. The wire 7 wound on the end surfaces 4*c* and 4*d* is prevented from slipping by the small areas 14 and 15 by the same reason described above in connection with the auxiliary rings of FIG. 7.

In the deflection yoke, the overall magnetic field spreading from the smaller opening on the electron gun side to the larger opening on the screen side influences the convergence, but the pincushion distortion is largely influenced by the magnetic field on the larger opening side. This is because the distance between the electron beam and the deflection coil when the electron beam is deflected is shorter on the larger opening side than on the electron gun side, and the electron beam on the larger opening side of the deflection coil travels through curved ends of the lines of magnetic flux so that the magnetic field on the larger opening side largely influences the pincushion distortion. It is seen from the above that the magnetic field distribution necessary to simultaneously compensate for both the nonconvergence and the pincushion distortion at the left and right edge of the screen only by the deflection yoke, is the vertical deflection magnetic field which forms the pincushion magnetic field on the larger opening side and the barrel magnetic field on the smaller opening side. Thus, the deflection yoke of the present invention can simultaneously compensate for both the misconvergence and the pincushion distortion at the left and right edges of the screen.

As described hereinabove, in accordance with the deflection yoke of the present invention, in order to form different shapes of magnetic field on the larger opening side and the smaller opening side, that is, in order to form the pincushion magnetic field on the larger opening side and form the barrel magnetic field on the smaller opening side, the winding angle of the vertical deflection coil at the larger opening is changed from that at the smaller opening, that is, the winding angle of the vertical deflection coil at the smaller opening is made larger than that at the larger opening. Furthermore, the magnetic material piece is disposed inside the vertical deflection coil to enhance the barrel magnetic field. As a result, the deflection yoke of the present invention can compensate for both the misconvergence and the pincushion distortion at the left and right edges of the screen.

Furthermore, the deflection yoke of the present invention includes a core having its end surfaces formed in sawtooth shape or auxiliary rings having sawtooth-shaped end surfaces. Accordingly, the wire of the vertical deflection coil is prevented from slipping on the end surfaces of the core although the wire of the vertical deflection coil is wound at the smaller opening with a large winding angle.

We claim:

1. A deflection yoke for a television receiver comprising:

a horn-shaped core having a larger opening and a smaller opening;

a horizontal deflection coil disposed inside said core;

a vertical deflection coil wound on said core so as to produce a pincushion shape magnetic field at said larger opening and a barrel shape magnetic field at said smaller opening with a winding angle of said vertical deflection coil at said smaller opening of said core being larger than a winding angle at said larger opening; and a magnetic material piece disposed inside said vertical deflection coil at a position, on said vertical deflection coil, close to said smaller opening.

2. A deflection yoke according to claim 1, wherein said magnetic material piece is bonded to said vertical deflection coil.

3. A deflection yoke according to claim 1, wherein said magnetic material piece is attached to a separator.

4. A deflection yoke according to claim 1, wherein said magnetic material piece is an iron plate.

5. A deflection yoke according to one of claims 1, 2, 3 or 4 wherein said magnetic material piece is disposed at a position separated from said larger opening by $\frac{1}{2}$–$\frac{3}{4}$ of a distance between said larger opening and said smaller opening.

6. A deflection yoke according to one of claims 1, 2, 3 or 4, wherein the width of said magnetic material piece is equal to 1/5–$\frac{1}{2}$ of the distance from said larger opening to said smaller opening of said core and the length of said magnetic material piece is chosen such that an angle looking into said magnetic material piece from the center of said deflection yoke is equal to 30°–70°.

7. A deflection yoke according to claim 1, wherein auxiliary rings, each having end surfaces formed into sawtooth shape, are attached to end surfaces of said core at said larger opening and said smaller opening to prevent a wire of said coil from slipping, said vertical deflection coil being wound on the sawtooth portions of said auxiliary rings.

8. A deflection yoke according to claim 1, wherein end surfaces of said larger opening and said smaller opening of said core are notched in sawtooth shape to prevent a wire of said coil from slipping, said vertical deflection coil being wound on the sawtooth portions of said end surfaces.

9. A deflection yoke according to claims 2 or 3, wherein said magnetic material piece is rectangularly shaped.

10. A deflection yoke according to claims 7 or 8, wherein said sawtooth shape includes small areas about which said wire of said coil is wound, each of said small areas defining a plane which is normal to said wire of said coil, whereby the tensile force acting on said wire is normal to said plane so as to prevent slipping of said wire.

* * * * *